US010093511B2

(12) United States Patent
Okada

(10) Patent No.: US 10,093,511 B2
(45) Date of Patent: Oct. 9, 2018

(54) IMAGE PROCESSING APPARATUS, CONTROL METHOD FOR IMAGE PROCESSING APPARATUS, AND PROGRAM

(71) Applicant: CANON KABUSHIKI KAISHA, Tokyo (JP)

(72) Inventor: Hideyuki Okada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 14/986,932

(22) Filed: Jan. 4, 2016

(65) Prior Publication Data

US 2016/0194173 A1 Jul. 7, 2016

(30) Foreign Application Priority Data

Jan. 7, 2015 (JP) ..... 2015-001684

(51) Int. Cl.
*B65H 37/04* (2006.01)
*G03G 15/00* (2006.01)

(52) U.S. Cl.
CPC ..... *B65H 37/04* (2013.01); *G03G 15/6544* (2013.01); *B65H 2408/1222* (2013.01); *B65H 2557/63* (2013.01); *B65H 2801/27* (2013.01)

(58) Field of Classification Search
CPC . B42F 3/003; G03G 2215/00852; B31F 1/07; B31F 5/02; B31F 2201/00; B65H 37/04; B65H 2301/43828; B65H 2301/51616
USPC ..... 270/58.07, 58.08, 58.09
See application file for complete search history.

(56) References Cited

U.S. PATENT DOCUMENTS 8,444,133 B2 * 5/2013 Kimura ..... G03G 15/6541 270/58.07
9,051,148 B2 * 6/2015 Ishizuka ..... B65H 37/04
2011/0304089 A1 * 12/2011 Kimura ..... B31F 5/027 270/58.08
2013/0214470 A1 * 8/2013 Yokomizo ..... B65H 37/04 270/1.01
2015/0021374 A1 * 1/2015 Kubo ..... B65H 37/04 227/39
2015/0023765 A1 * 1/2015 Hongu ..... B65H 43/06 412/33
2015/0037119 A1 * 2/2015 Tanaka ..... B42B 5/00 412/33

FOREIGN PATENT DOCUMENTS

JP 2013-170067 A 9/2013

* cited by examiner

*Primary Examiner* — Leslie A Nicholson, III
(74) *Attorney, Agent, or Firm* — Canon U.S.A., Inc. IP Division

(57) ABSTRACT

In printing processing, an MFP determines whether the number of printed sheets is less than or equal to an upper limit of bindable sheets of staple-less binding in a case where staple-less binding is set in print data. If the MFP determines that the number of printed sheets is less than or equal to the upper limit, the MFP determines whether binding processing is to be performed by switching to staple-less binding. If the MFP determines to perform binding processing by switching, the binding processing is performed by staple binding.

13 Claims, 13 Drawing Sheets

IMAGE PROCESSING APPARATUS, CONTROL METHOD FOR IMAGE PROCESSING APPARATUS, AND PROGRAM

BACKGROUND

Field

Aspects of the present invention generally relate to an image processing apparatus that performs binding processing on a plurality of sheets on which images are printed.

Description of the Related Art

In recent years, image processing apparatuses have been proposed in which sheets can be bound through one of a binding process for binding sheets by using a staple or staples and a binding process for binding sheets without using a staple.

For binding sheets without using a staple, the sheets may be crimped for binding. However, the upper limit of the number of sheets which can be bounded without using a staple may often be less than that of the binding process using a staple. Therefore, when a user attempting to execute a printing or copy function designates a binding process for binding sheets without using a staple, the printed or copied sheets may not possibly be bound because the number of sheets to be bound exceeds the upper limit of the bindable sheets.

In view of the above, an image processing apparatus (Japanese Patent Laid-Open No. 2013-170067) switches the binding processing from a binding process for binding sheets without using a staple to a binding process for binding sheets by using a staple if the sheets can be bound by using a staple even when the number of sheets to be bound is greater than the upper limit of the number of bindable sheets.

In an image processing apparatus disclosed in Japanese Patent Laid-Open No. 2013-170067, when a user designates a binding process for binding sheets without using a staple but the number of sheets to be bound is greater than the upper limit of the number of bindable sheets without using a staple, a binding process for binding sheets by using a staple is executed. This may prevent outputting sheets without being bound though a user expects that a bounded document will be output.

On the other hand, some environments such as worksites relating to food, medical sites, and manufacturing sites may preferably be refrained from using sheets bound by using staples in order to avoid contamination with a piece of metal. The binding process for binding sheets without using a staple is achieved by crimping sheets. Thus, sheets can be peeled off easily from each other by smoothing the bound position or applying force to the bound position. Intending to peel off the sheets from each other later, such a binding process for binding sheets without using a staple may be performed by using the feature.

In some cases, there is a possibility that a user with the intention may designate such a binding process for binding sheets without using a staple. Therefore, the switch to the binding process for binding with a staple may be caused even though the user intends to designate the binding process for binding without using a staple, which may possibly provide an output result against the user's intention. Accordingly, when a binding process for binding sheets without using a staple is designated and the number of sheets to be bound is greater than an upper limit of the number of sheets bindable without using a staple, it is desirable that the switching to the binding process for binding sheets with a staple is not caused.

SUMMARY

Aspects of the present invention were provide an image processing apparatus that appropriately shifts to a binding process for binding with a staple so that the binding process according to a user's application can be executed.

A sheet processing apparatus includes a first binding unit configured to perform a first binding process on sheets, a second binding unit configured to perform a second binding process on a number of sheets that is greater than an upper limit of sheets the first binding unit can perform the first binding process on, a setting unit configured to set whether switching to the second binding unit is executed in a case where a number of sheets to be bound is greater than the upper limit of sheets the first binding unit can perform the first binding process on, and a control unit configured to, when switching to the second binding unit is set not to be executed, control not to execute the second binding process even in a case where the number of sheets to be bound is greater than the upper limit of sheets the first binding unit can perform the first binding process on.

Further features of the present disclosure will become apparent from the following description of exemplary embodiments with reference to the attached drawings.

DESCRIPTION OF THE EMBODIMENTS

Embodiments of aspects of the present invention will be described below in detail with reference to drawings. It should be understood that the following embodiments are not intended to limit the aspects of the claimed invention and that all of combinations of characteristics in the embodiments are not necessary for achieving the aspects of the invention.

First Embodiment

Figure 1:
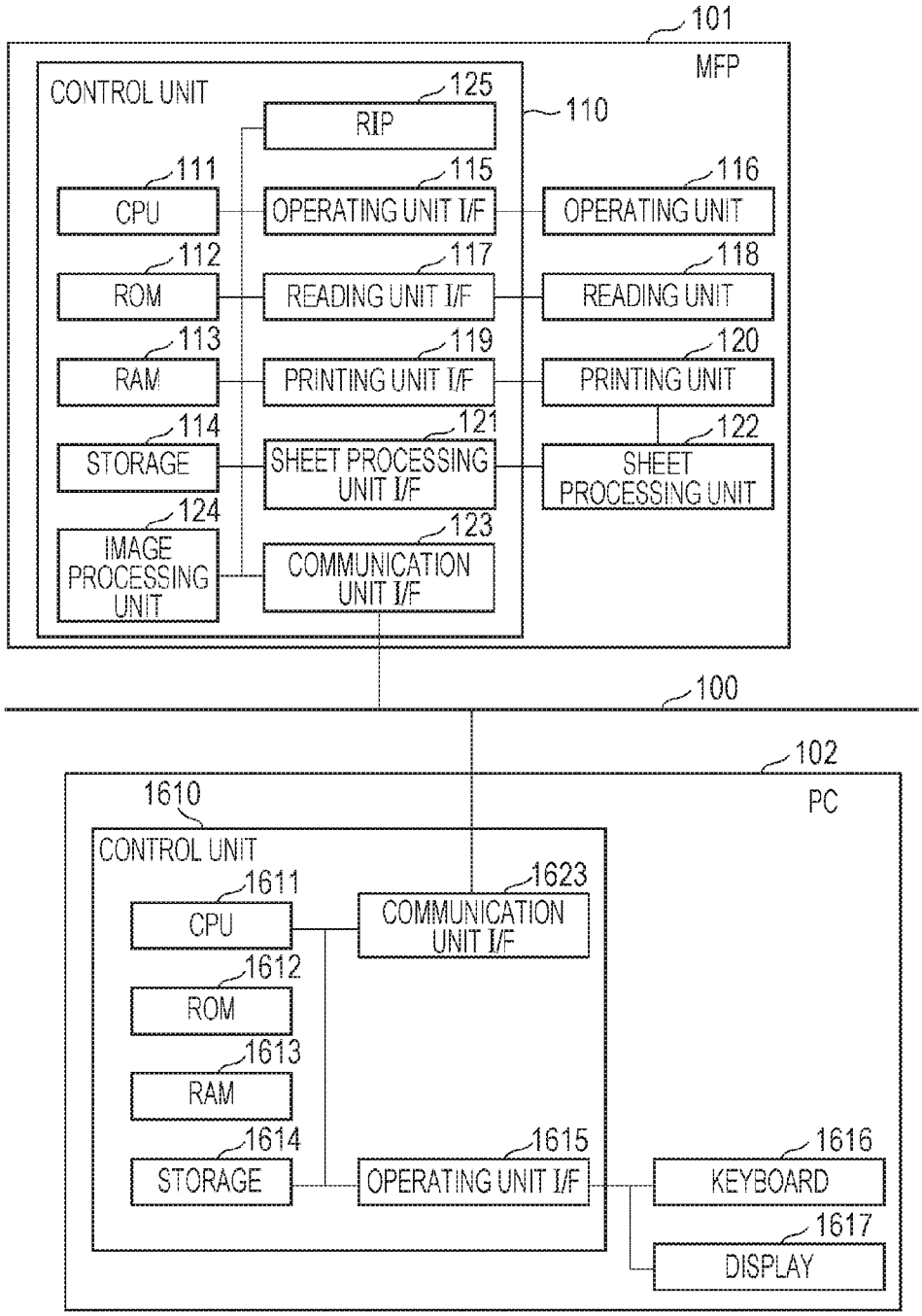
FIG. 1 is a block diagram illustrating an image processing system.

A first embodiment of aspects of the present invention will now be described. FIG. 1 is a block diagram illustrating an image processing system according to this embodiment. In this embodiment, a multifunction peripheral (MFP) 101 is provided as an example of the image processing apparatus.

A personal computer (PC) 102 is an example of an information processing apparatus. The MFP 101 and the PC 102 are communicatively connected over a network 100.

The PC 102 will be described first. A control unit 1610 including a CPU 1611 is configured to control operations to be performed by the information processing apparatus as a whole. The CPU 1611 reads out a system program and an application program stored in the ROM 1612 or the storage 1614 for performing processing. A ROM 1612 is configured to store a control program executable by the CPU 1611. A RAM 1613 serves as a main memory for the CPU 1611 and is usable as a temporary storage area for decompressing programs stored in a work area and the storage 1614 and data to be used by programs and control variables. The storage 1614 is configured to store set values registered by a user, management data for the information processing apparatus, application programs such as a document application, a computing application, and a driver program for transmitting print data to the MFP 101. While this embodiment assumes that the storage 1614 is an auxiliary memory device such as an HDD, a nonvolatile storage device such as a flash disk such as an SSD may be used instead of the HDD. It should be noted that the information processing apparatus of this embodiment executes processing described in each of flowcharts, which will be described below, to be executed by the one CPU 1611 by using one memory (RAM 1613) while other modes are also applicable. For example, a plurality of CPUs, RAMs, ROMs, and storages may operate in collaboration for execution of the processing illustrated in the flowcharts which will be described below.

An operating unit I/F 1615 connects an input/output device and the control unit 1610. A user may use an input device such as a keyboard 1616 and a mouse (not illustrated) to input an instruction such as a selection of a key displayed on a display 1617. The control unit 1610 is connected to the network 100 through a communication unit I/F 1623. The communication unit I/F 1623 may transmit data to an external device and receive data from an external device on the network 100 over a network such as a wired LAN or a wireless LAN.

The control unit 1610 may transmit print data to the image processing apparatus and receive image data from the image processing apparatus through the communication unit I/F 1623. According to this embodiment, the information processing apparatus includes a keyboard and a display, for example. However, the information processing apparatus may be a mobile information terminal such as a smart phone or a tablet terminal. It should be noted that print data may be transmitted to the image formation apparatus by various methods. Print data may be transmitted to the image formation apparatus through an application or driver for printing, or print data may be transmitted to the image formation apparatus through a cloud server. Furthermore, a communication method such as Bluetooth (registered trademark) or near-field communication (NFC) may be used to transmit print data to the image formation apparatus.

Next, the MFP 101 will be described. The MFP 101 has a reading function for reading an image on a sheet and a printing function for printing an image on a sheet. The MFP 101 may further have post-processing functions including binding a plurality of sheets on which images are printed, aligning a plurality of sheets, and dividing a plurality of sheets for a plurality of destination trays. The sheets here may be plain paper, thick paper and OHP sheets.

While the MFP 101 is described as an example of the image processing apparatus according to this embodiment, the image processing apparatus may be, for example, a printer without a reading function or an image processing apparatus having a single copying function only. This embodiment assumes, as an example, that the image processing apparatus has the following configuration requirements.

A control unit 110 including a CPU 111 generally controls operations of the MFP 101. The CPU 111 reads out a control program stored in a ROM 112 or a storage 114 to perform controls such as a reading control and a print control. The ROM 112 stores a control program executable by the CPU 111. The ROM 112 may further store a boot sequence and font information. A RAM 113 serves as a main memory for the CPU 111 and is usable as a temporary storage area for decompressing control programs stored in a work area, the ROM 112 and the storage 114. The storage 114 may store image data, print data, programs, history information, and setting information. While this embodiment assumes an auxiliary memory device such as an HDD as the storage 114, a flash disk such as an SSD may be used instead of the HDD.

It should be noted that while the MFP 101 of this embodiment executes processing described in each of flowcharts, which will be described below, to be executed by the one CPU 111 by using one memory (RAM 113), other modes are also applicable. For example, a plurality of CPUs, RAMs, ROMs, and storages may operate in collaboration for execution of the processing illustrated in the flowcharts which will be described below. Alternatively, a hardware circuit such as an ASIC and an FPGA may be used to execute a part of the processing.

Figure 2:
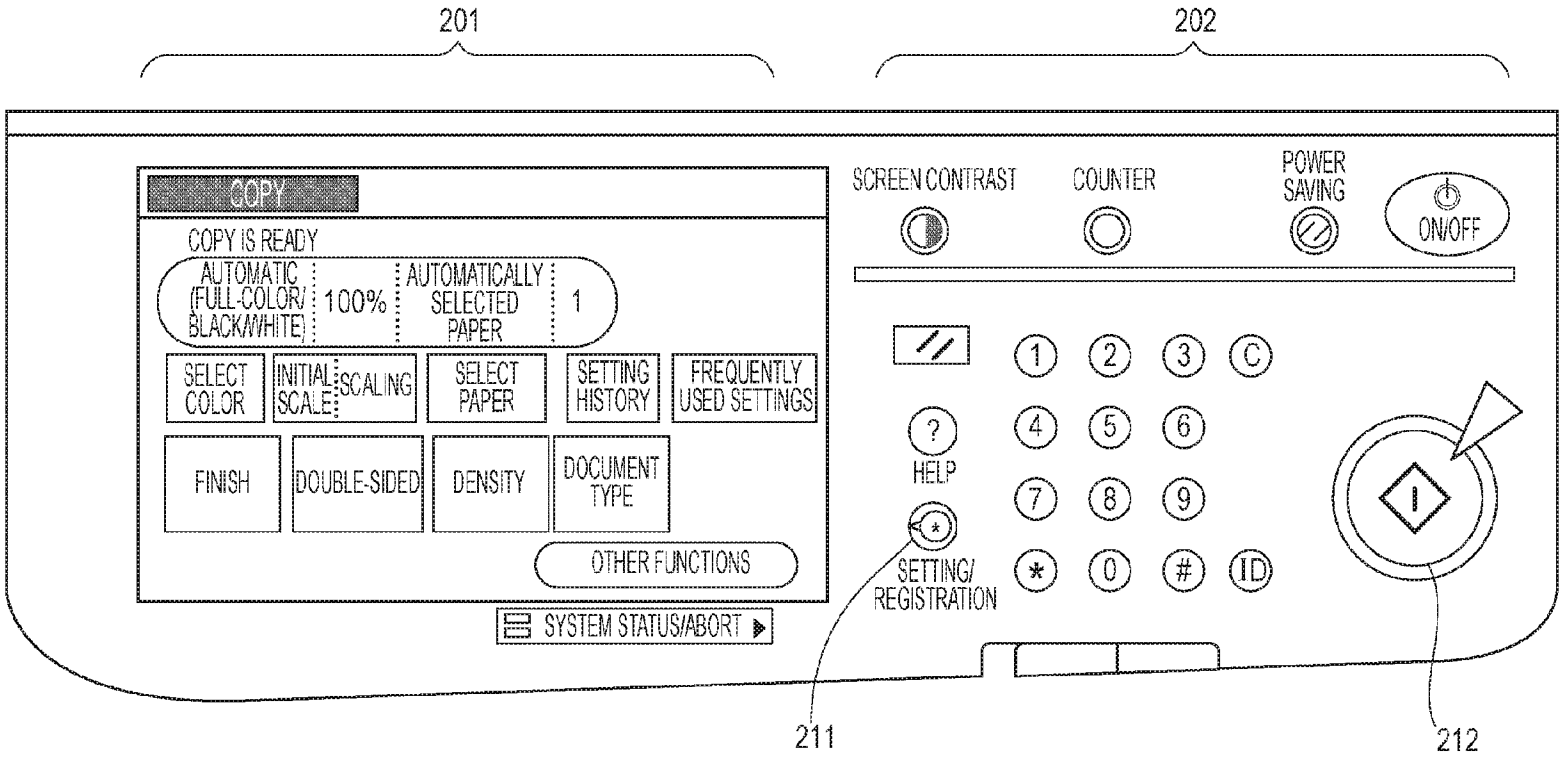
FIG. 2 illustrates an operating unit.

An operating unit I/F 115 connects an operating unit 116 and the control unit 110. The operating unit 116 is configured to present information to a user and receive input of an instruction from a user. FIG. 2 is an outer appearance view of the operating unit 116. The operating unit 116 includes a panel 201 configured to display an operating screen and a hardware key input unit 202. The panel 201 may be a touch panel display, for example. The hardware key input unit 202 has hardware keys including a start button 212 and a setting button 211. A user may input an instruction by touching a key displayed on the panel 201 or pressing a hardware key in the hardware key input unit 202. The panel 201 may be a display without a touch panel function. In this case, instead of a key input through a touch operation, a scroll key for selecting a key shown on the display and a determination key for confirming the key operation may be provided in the hardware key input unit.

The operating unit 116 displays an operating screen on the panel 201 as required in response to an instruction from a user through the panel 201 and input unit 202.

A reading unit I/F 117 connects a reading unit 118 and the control unit 110. The reading unit 118 is configured to read an image on a sheet and converts the image to image data such as binary data. The image data generated by the reading unit 118 is transferred to an image processing unit 124 through the reading unit I/F 117. The image processing unit 124 performs image processing such as rotating and compressing of image data. The image data having undergone the image processing is stored in the storage 114 or RAM 113 in the control unit 110. The image data may be transmitted to an external device through a communication unit I/F 123 or may be printed on a sheet. The image processing unit 124 is configured to perform compression processing and decompression processing on image data stored in the RAM 113 and storage 114 according to a compression method such as JBIG and JPEG.

A print unit I/F 119 connects a print unit 120 and the control unit 110. Image data to be printed (or print target image data) is transferred from the control unit 110 to the print unit 120 through the print unit I/F 119. The print unit 120 receives a control command and image data to be printed from the CPU 111 and prints an image based on the image data on a sheet such as paper.

A sheet processing unit I/F 121 connects a sheet processing unit 122 and the control unit 110. The sheet processing unit 122 receives a control command from the CPU 111 and performs post-processing on the sheet having undergone printing performed by the print unit 120 in accordance with the control command. For example, the post-processing to be executed may include aligning a plurality of sheets, dividing a plurality of sheets for a plurality of destination trays, saddle stitching, punching, and binding a plurality of sheets. The functions of the post-processing and capability of the post-processing of the sheet processing unit are notified to the control unit 110 through the sheet processing unit I/F 121 in advance (such as upon start of the MFP 101) and are notified to the storage 114 or RAM 113.

According to this embodiment, the sheet processing unit 122 is capable of executing at least a binding process (binding unit) for binding a plurality of sheet with staples and a binding process (binding unit) for binding a plurality of sheet without staples.

The control unit 110 is connected to the network 100 through the communication unit I/F 123. The communication unit I/F 123 may transmit image data and information to an external device (such as an e-mail server, a file server, and a PC) present on the network 100 and receive print data and information from an information processing apparatus present on the network 100. FIG. 1 illustrates the PC 102 as an example of the information processing apparatus. Furthermore, the communication unit I/F 123 may communicate with an external device through a local interface such as a USB. Print data received by the communication unit I/F 123 is stored in the storage 114.

The print data received through the communication unit I/F 123 is analyzed by a software module (PDL analyzing unit, not illustrated) for analyzing print data stored in the storage 114 or ROM 112. The PDL analyzing unit analyzes print data expressed in various types of page description language (PDL) stored in the storage 114. The print data include code relating to a print attribute and code relating to rendering. For print data, the number of copies to be printed, which is set for the whole print data or for each page, information regarding a binding process, print attribute information regarding an output sheet size, a sheet type and a feeding stage are set.

The PDL analyzing unit temporarily stores settings (print attribute information) regarding print attributes acquired by analyzing print data in the RAM 113 or storage 114.

The PDL analyzing unit may further generate intermediate code from print data. The PDL analyzing unit may analyze rendering code included in the print data and convert it to intermediate code. The intermediate code is data having a format more suitable for rendering processing (rasterizing) compared with print data itself and mainly contains coordinates of edges and paint-out data for a space between edges.

The PDL analyzing unit may calculate the number of sheets to be output from a result of the PDL analysis and stores it as print attribute information in the RAM 113 or storage 114. The print attribute information acquired or calculated by the PDL analyzing unit is referred as required during print processing based on the print data and during post-processing performed by the sheet processing unit 122. The intermediate code generated by the PDL analyzing unit is converted to image data by an RIP 125.

The RIP 125 performs rendering processing on the intermediate code generated by the PDL analyzing unit to generate image data to be printed by the print unit 120. The image data generated by the RIP 125 is stored in the storage 114 or RAM 113 in the control unit 110 and may be transmitted to an external device through the communication unit I/F 123 or may be printed on a sheet by the print unit 120.

Figure 3:
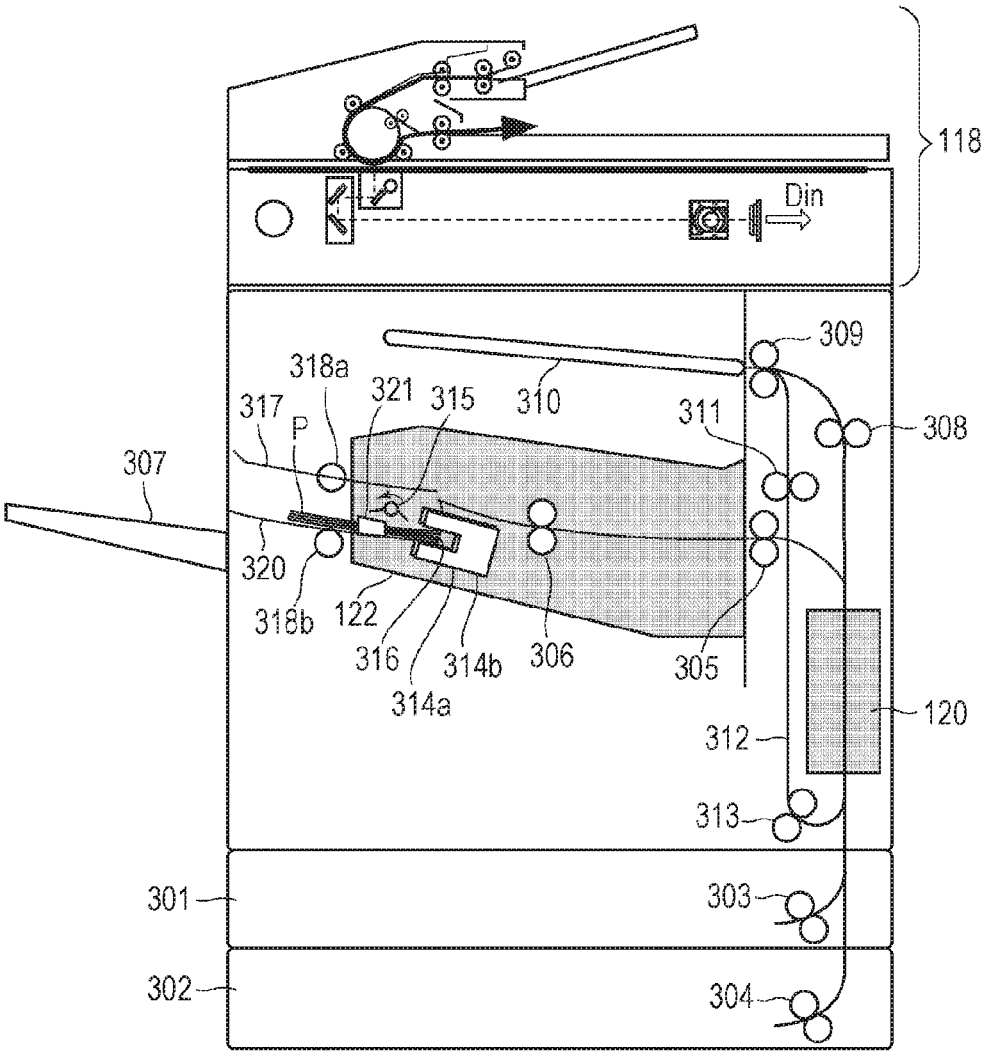
FIG. 3 is a cross-section view of an MFP.

FIG. 3 illustrates a cross-section view of the MFP 101. Referring to FIG. 3, the sheet processing unit 122 is arranged inside a housing of the MFP 101. The arrangement of the sheet processing unit 122 is not limited to the example in FIG. 3. The sheet processing unit 122 may be connected adjacently to the MFP 101.

Each of feeder units 301 and 302 stores sheets. Though the MFP 101 has two feeder units in FIG. 3, the number of feeder units is not limited to two. A conveyance roller 303 conveys sheets stored in the feeder unit 301 to the print unit 120. A conveyance roller 304 conveys sheets stored in the feeder unit 302 to the print unit 120. The print unit 120 prints an image on a first side of the conveyed sheet. The print unit 120 may apply an ink-jet method for printing an image by spraying ink to a sheet or electrophotography for printing an image by fixing toner to a sheet.

In single-sided printing, a printed sheet is guided to conveyance rollers 305 and 306, and the conveyance rollers 305 and 306 convey the sheet to the sheet processing unit 122. The sheet guided by the conveyance roller 306 is output to an intermediate tray 320.

The intermediate tray 320 is declined with its downstream side in the sheet conveying direction (left side in FIG. 3) at a vertically higher position and its upstream side (right side in FIG. 3) at a vertically lower position and is capable of holding a plurality of sheets. The intermediate tray 320 has a batch discharging roller pair 318 including a set of upper and lower batch discharging rollers **318*a* and 318*b* provided on the downstream side and a draw paddle 315 provided at an upper part in the middle part. The upper batch discharging roller 318*a* is supported by a guide 317**.

The guide 317 is configured such that it can be vertically moved by a motor (not illustrated). Thus, the upper batch discharging roller **318*a* provided on the guide 317 can be detachably attached to the lower batch discharging roller 318*b* by rise and fall operations of the guide 317. Thus, the interval between the rollers of the batch discharging roller pair 318** can be adjusted in accordance with the thickness of the sheet bundle held in the intermediate tray.

The CPU 111 moves the guide 317 upward such that the lower batch discharging roller **318*b* is moved away from the upper batch discharging roller 318*a* and then accepts a sheet P output through the conveyance roller 306 onto the intermediate tray 320**.

An alignment member 321 is provided on the near side and the far side in the width direction orthogonal to the sheet conveying direction on the intermediate tray 320. The alignment member 321 is moved in the width direction by a front alignment motor (not illustrated) and a rear alignment motor (not illustrated). The term "near side" here refers to a near part in FIG. 3 by viewing the MFP 101 in the orientation illustrated in FIG. 3, and the term "far side" refers to the far part in FIG. 3. The draw paddle 315 rotates in a direction in which a sheet is pressed toward a stopper 316 about the rotational axis (or in counterclockwise direction in FIG. 3).

The sheet P guided through the conveyance roller 306 and output onto the intermediate tray 320 slips on a mounting surface of the intermediate tray 320 or on a sheet mounted on the intermediate tray 320 due to the declination of the intermediate tray 320 and the action of the draw paddle 315 for pressing a sheet.

The sheet output onto the intermediate tray 320 undergoes an alignment process performed by the alignment member 321 during the slipping and stops when the rear end of the sheet (end on the upstream side of the discharge direction) comes to the stopper 316.

The sheet bundle aligned on the intermediate tray 320 undergoes a binding process performed by the staple binding unit 314*a* or staple-less binding unit 314*b* as required. The staple binding unit 314*a* and the staple-less binding unit 314*b* are configured to be movable in the direction orthogonal to the sheet conveying direction so that a sheet bundle can be moved to a binding position designated by a user. The binding units 314*a* and 314*b* are capable of binding a rear end part in the conveying direction of the sheet bundle held on the intermediate tray 320.

The sheet bundle having undergone post-processing such as a binding process performed by the sheet processing unit 122 is output to the output unit 307. More specifically, the guide 317 is moved such that the batch discharging roller 318*a* can be abutted against an uppermost sheet on the intermediate tray 320, and under this condition, the batch discharging roller pair 318 is driven to rotate so that the sheet bundle having undergone post-processing is output onto the output unit 307.

Next, in double-sided printing, a sheet having a first side printed by the print unit 120 is guided to the conveyance roller 308, and the conveyance roller 308 conveys the sheet to the conveyance roller 309. The conveyance roller 309 conveys the sheet to an inversion path 310. When a rear end of the sheet reaches the conveyance roller 309, the conveyance roller 309 starts reversely rotating so that the sheet is conveyed to the conveyance roller 311. The conveyance roller 311 conveys a sheet to the conveyance roller 313 through a double-sided printing conveyance path 312. The conveyance roller 313 conveys the sheet to the print unit 120. The print unit 120 prints an image on a second side of the sheet. The sheet having undergone the double-sided printing is guided to the conveyance rollers 305 and 306, and the conveyance rollers 305 and 306 convey the sheet to the sheet processing unit 122. Like the single-sided printing, post-processing such as a binding process is executed on the sheet.

Figure 4:
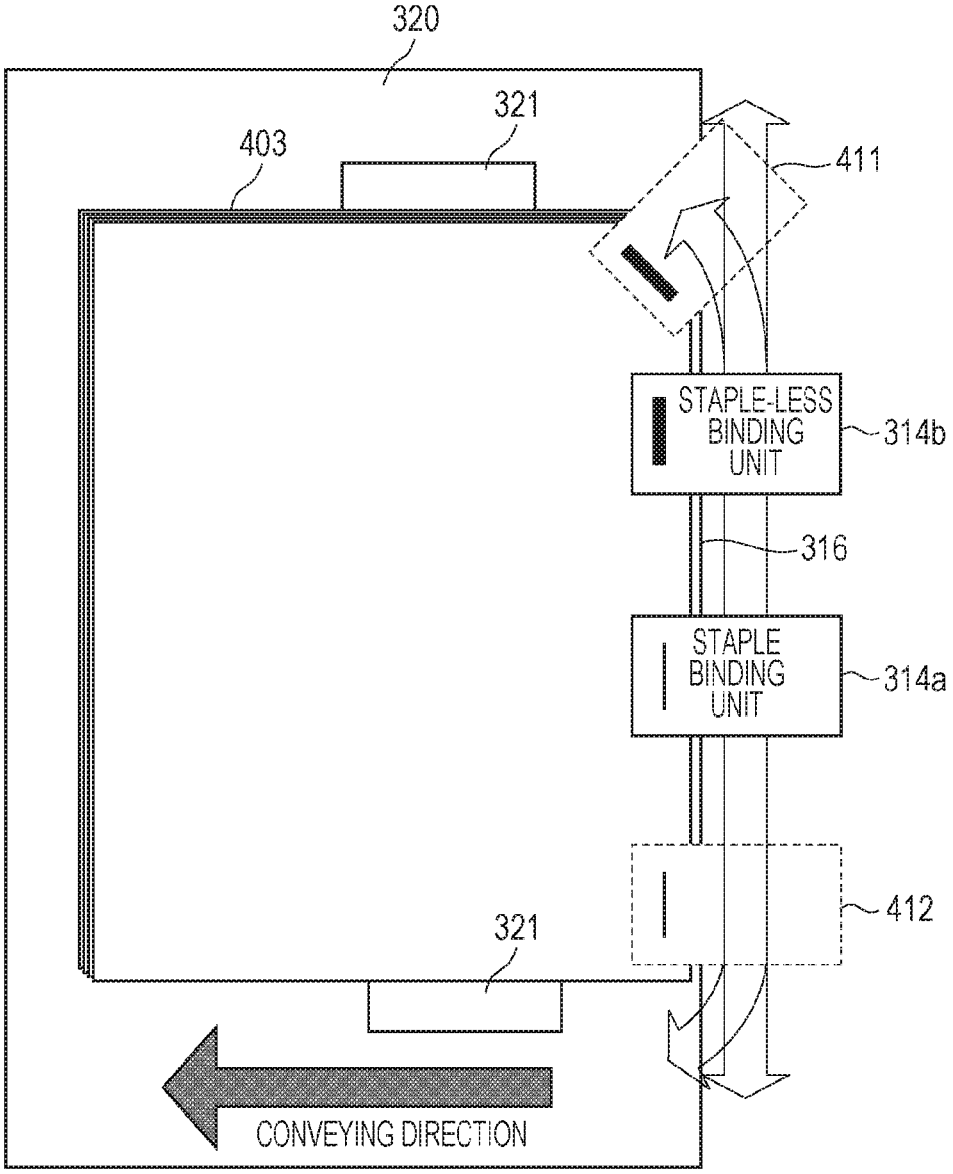
FIG. 4 is a diagram for explaining a binding process performed by a binding unit.

FIG. 4 is a diagram for explaining a position where binding is performed by the binding unit 314*a* or 314*b* (which will be called a binding position below). FIG. 4 illustrates a plurality of sheets 403. The sheet processing unit 122 is configured to bind a plurality of sheets by moving the binding unit 314*a* or 314*b* to the binding position based on information regarding a binding process received from the CPU 111. For example, the CPU 111 moves the binding unit 314*a* or 314*b* to a position 411 or a position 412, for example, so that a bundle 403 of a plurality of sheets at the position 411 or position 412.

The staple binding unit 314*a* and the staple-less binding unit 314*b* may be integrated into one unit to be provided within the sheet processing unit 122. Movable areas of the binding units 314*a* and 314*b* are indicated by the arrows in FIG. 4, but they may be much wider areas. When the staple-less binding unit 314*b* and the staple binding unit 314*b* (not illustrated) are provided as separate units, an evacuation area may be provided for avoiding physical interference between the units.

The staple binding unit 314*a* performs a binding process by driving a staple (not illustrated) into a plurality of sheets output onto the intermediate tray 320 (hereinafter, called a staple binding). The staple binding unit 314*a* stores a cartridge (not illustrated) filled with staples. A user can supplement staples by replacing the cartridge.

The CPU 111 acquires an upper limit of the number of sheets (such as 100 sheets of plain paper) bindable by the staple binding unit 314*a* through the sheet processing unit 122 and the sheet processing unit I/F 121 as required and stores it in the RAM 113 or the storage 114. The information regarding the upper limit of the number of bindable sheets is used in the flowchart. It should be noted that the upper limit of the number of bindable sheets may depend on the length of staples filled in the cartridge.

Figure 5A:
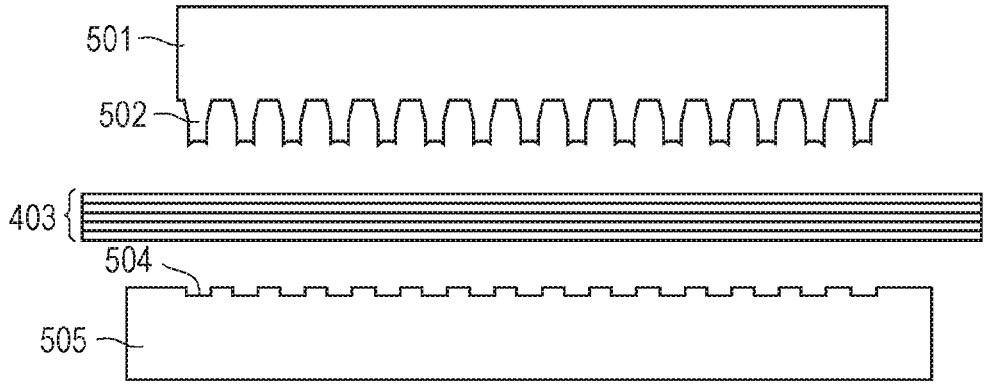
FIGS. 5A to 5C illustrate a binding process performed by a staple-less binding unit.
Figure 5B:
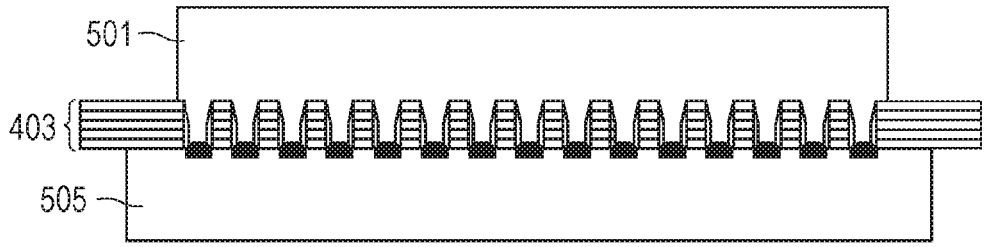
Figure 5C:
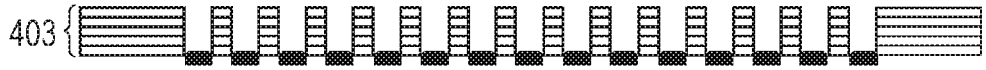

FIGS. 5A, 5B, and 5C illustrate a binding process to be performed by the staple-less binding unit 314*b*. The staple-less binding unit 314*b* according to this embodiment applies pressure to a plurality of sheets from the top and the bottom and binds the tight sheet bundle 403. FIG. 5A illustrates a state acquired by moving the sheet bundle 403 to a binding position performed by the staple-less binding unit 314*b*. An upper mold 501 presses the plurality of sheets from the above. The upper mold 501 has a plurality of convex-shaped blades 502, and each of the blades 502 applies pressure to the sheets. A lower mold 505 presses a plurality of sheets from the bottom. The lower mold 505 has a plurality of concaves 504*a* corresponding to the plurality of blades 502, and each of the concaves 504 receive the corresponding blade 502.

FIG. 5B illustrates a state acquired by pressing the plurality of sheet by the upper mold 501 and the lower mold 505 from the top and the bottom. The upper mold 501 and the lower mold 505 press the plurality of sheets so as to bind the plurality of sheets. Because the plurality of blades 502 and the plurality of concaves 504 press the sheets at a plurality of positions, the sheets are not peeled easily from each other.

The CPU 111 acquires as required an upper capability of binding of the staple-less binding unit 314*b* (such as 10 sheets of plain paper) through the sheet processing unit 122 and the sheet processing unit I/F 121 and stores it in the RAM 113 or the storage 114. The information regarding the upper capability is used in a flowchart, which will be described below.

It should be noted that the upper limits of the number of bindable sheets of the staple binding unit 314*a* and staple-less binding unit 314*b* may vary in accordance with the paper type of sheets. The upper limits of the number of bindable sheets may vary in accordance with the size of the sheets.

Figure 6:
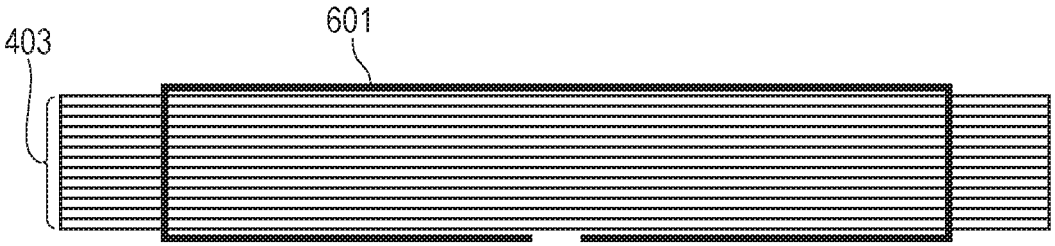
FIG. 6 illustrates a binding process to be performed by staple binding unit.

FIG. 5C illustrates the sheet bundle 403 having undergone the staple-less binding. As illustrated in FIG. 5C, the sheet bundle 403 having undergone the staple-less binding is bound by crushing parts of the sheets and cramping the sheets. FIG. 6 illustrates a binding process of staple binding. As illustrated in FIG. 6, the sheet bundle 403 having undergone the staple binding is bound with a metallic staple 601 penetrating through the sheet bundle 403.

Because the staple-less binding crimps sheets for binding, the number of bindable sheets is less than that of the staple binding which binds sheets by penetrating a staple through sheets. The number of sheets bindable by the staple-less binding may vary in accordance with the paper type of sheet because the force for cramping sheets may vary in accordance with the surface nature, grammage and so on of the sheets. Therefore, there is a high possibility that though a user attempting to execute printing or copying designates a staple-less binding process, the printed or copied sheets are not output because the number of sheets to be bound is greater than the upper limit of the number of bindable sheets.

In view of this, there may be a case where even when the number of sheets to be bound is greater than the upper limit of the number of sheets bindable by the staple-less binding, the binding process is switched to the staple binding if the staple binding can bind the sheets.

On the other hand, some environments such as worksites relating to food, medical sites, and manufacturing sites may preferably be refrained from using sheets bound by staple binding in order to avoid contamination with a piece of metal. The staple-less binding is achieved by crimping sheets. Thus, intending to peel off the sheets from each other later, sheets can be peeled off easily from each other by smoothing the bound position or applying force to the bound position. The staple-less binding may be performed by using the feature.

When a user intends to do so and designates the staple binding, switching to the staple binding may result in output against the user's intension.

In view of this, according to this embodiment, whether switching to staple binding is permitted or not is set, and binding processing is performed in accordance with the setting.

The MFP 101 of this embodiment supports staple binding and staple-less binding for binding processing. A user utilizing the MFP 101 may designate binding processing of either staple binding or staple-less binding for binding sheets after print processing or copy processing. On the other hand, when binding processing is not designated, a sheet bundle is output without performing binding processing.

Furthermore, according to this embodiment, whether the binding processing is switched to staple binding or not when staple-less binding is designate for a sheet bundle of a greater number of sheets may be set as an operational setting for the whole MFP 101.

Figure 7A:
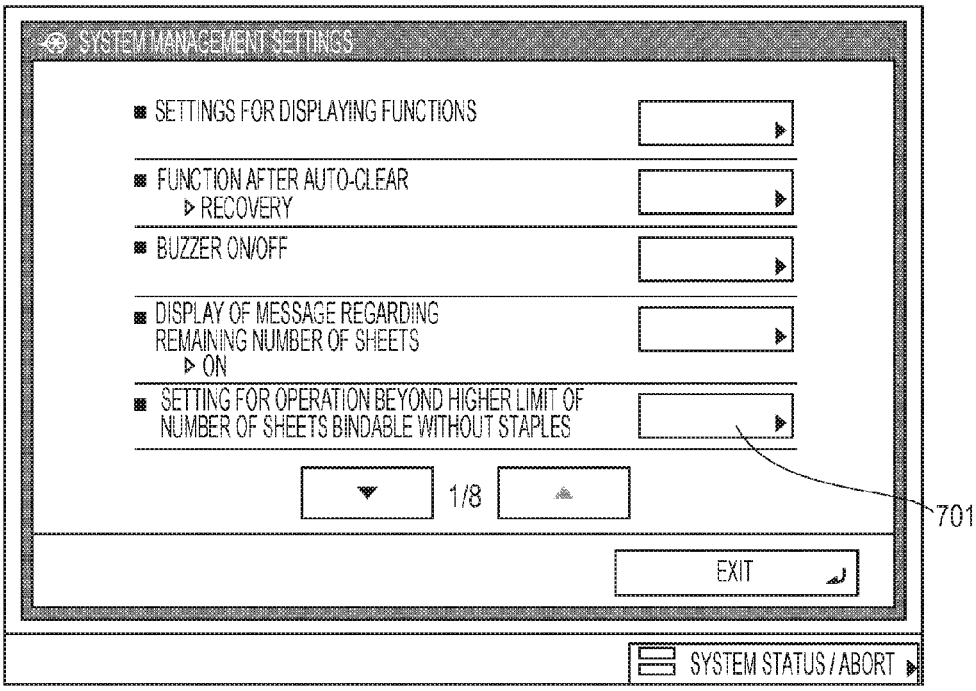
FIGS. 7A and 7B illustrate operating screens to be displayed on a panel.
Figure 7B:
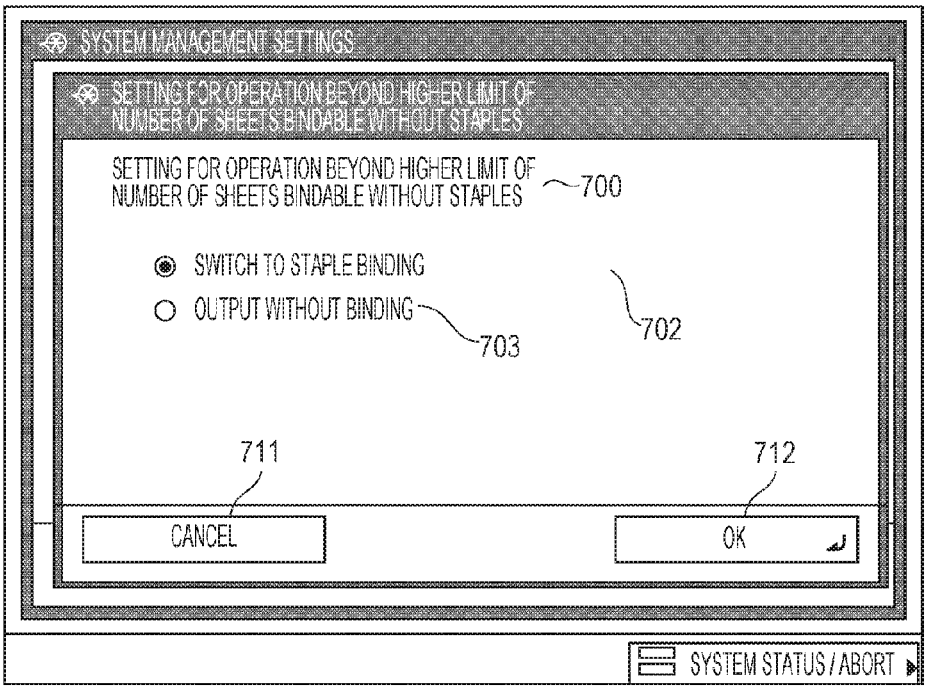

A user may press the setting button 211 in the operating unit 116 for changing a setting relating to a function included in the MFP 101 and an operation to be performed by the MFP 101 when the corresponding event occurs. FIGS. 7A and 7B illustrate example operating screens to be displayed on the panel 201 in the operating unit 116 by the CPU 111. FIG. 7A illustrates an example setting screen relating to functions included in the MFP 101 to be displayed on the panel 201 in the operating unit 116. A user may select an item illustrated in FIG. 7A to define the corresponding setting for a function or operation of the MFP 101. For example, for execution of a print job for which a paper discharge destination is automatically set, a setting for an output unit to which the resulting matter is to be output by priority and a setting for whether a job in which an error is occurring is to be deleted or not may be defined. A key 701 is usable for setting, as an operational setting of the whole MFP 101, whether binding processing is to be switched to staple binding or not when the number of sheets to be bound is greater than the upper limit of the number of sheets bindable by staple-less binding.

The CPU 111 controls the operating unit 116 so as to display the operating screen illustrated in FIG. 7B in response to a touch on the key 701 through the screen in FIG. 7A.

It should be noted that the settings defined through the screens in FIGS. 7A and 7B are held in a non-volatile area such as an SRAM provided as a part of the RAM 113. The non-volatile area can hold settings even when the power is shut off because power is supplied from a battery, for example, in a case where the MFP 101 is powered off. The setting information may be stored in the storage 114.

FIG. 7B illustrates an example setting screen relating to staple-less binding to be displayed by the panel 201 of the operating unit 116. Information 700 is usable for notifying a user of that an operation may be set for a job for which the staple-less binding is designated but in which the number of sheets to be bound is greater than the upper limit of the number of sheets bindable by the binding processing performed by the staple-less binding unit 314*b*. In response to a touch on a key 702, the CPU 111 enables the setting for performing binding processing by switching to staple binding when the number of sheets to be bound is greater than the upper limit of the number of sheets bindable by staple-less binding of the binding processing. In response to a touch on a key 703, the CPU 111 disables the setting for performing binding processing by switching to staple binding when the number of sheets to be bound is greater than the upper limit of the number of sheets bindable by staple-less binding of the binding processing. The key 702 and the key 703 support a toggle operation, and, as illustrated in FIG. 7B, when one key is selected, the selected key is displayed such that a user can clearly recognize the selected key.

A key 712 is usable for storing a setting relating to staple-less binding defined by a user in a non-volatile area and closing the setting screen. In response to a touch on the key 712, the CPU 111 acquires the selected key. If it is determined that the key 702 has a selected state, a switching permission flag is set to ENABLE. The switching permission flag is referred as required in a flowchart which will be described below. On the other hand, a key 711 is usable for discarding a setting relating to staple-less binding defined by a user and closing the setting screen.

Figure 8:
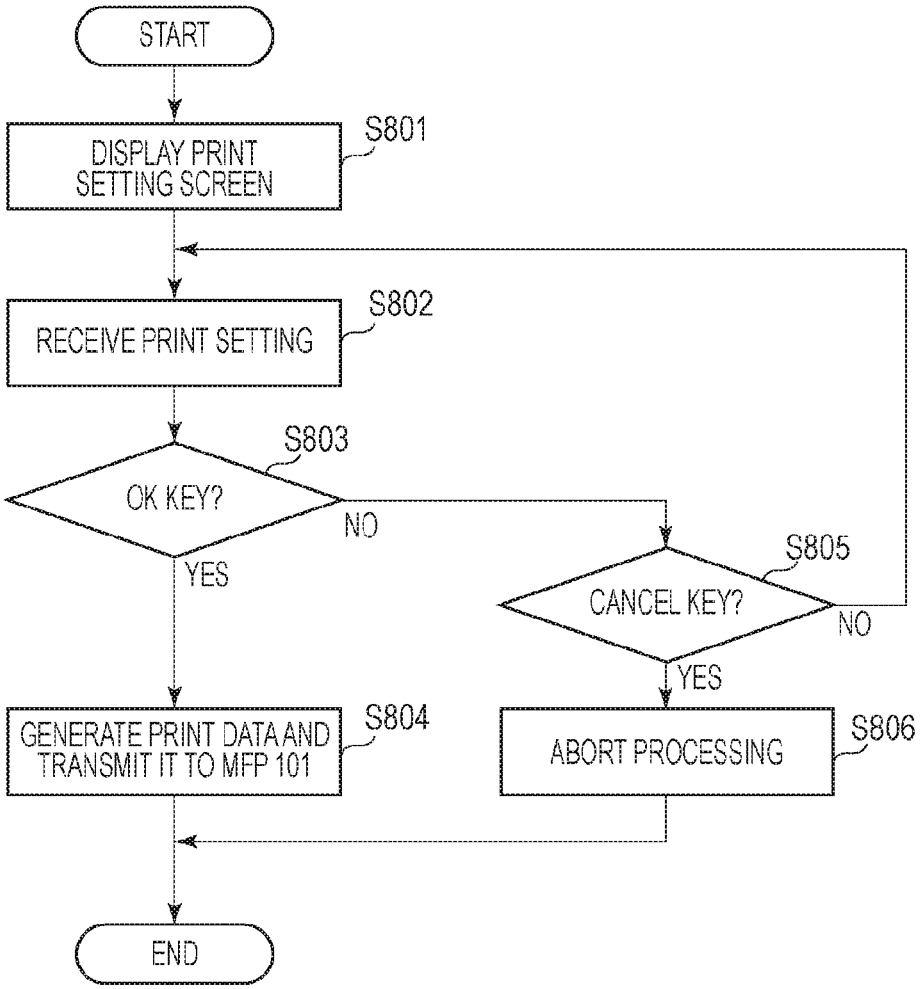
FIG. 8 is a flowchart illustrating control for transmitting print data in a PC.

Next, print processing according to this embodiment will be described. FIG. 8 is a flowchart illustrating a control method including transmitting print data to the MFP 101 by the PC 102. Operations (steps) in the flowchart in FIG. 8 are implemented by execution of a driver program based on the flowchart by the CPU 1611 in the PC 102. When a user instructs to print data, the CPU 1611 executes a driver program. First, in step S801, the CPU displays an operating screen for defining settings for printing on the display 1617. Through the operating screen, a user can set the size of the document, the size of print paper (sheet), the type of binding process, the number of copies, the orientation of printing, a page layout (page aggregation) and so on.

Figure 9A:
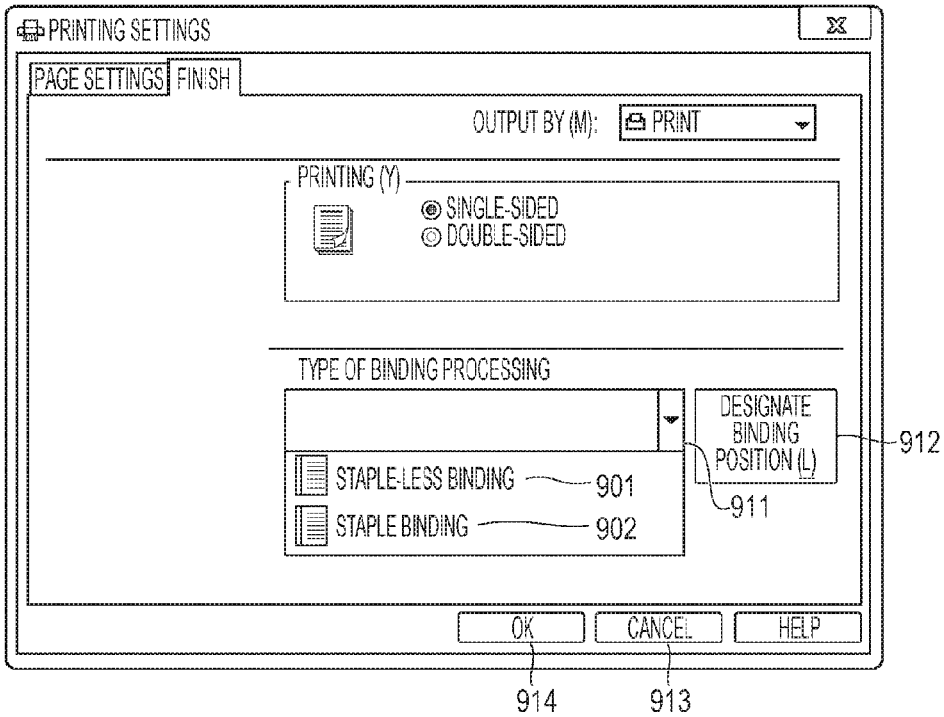
FIGS. 9A and 9B illustrate example display screens for defining print settings in the PC.
Figure 9B:
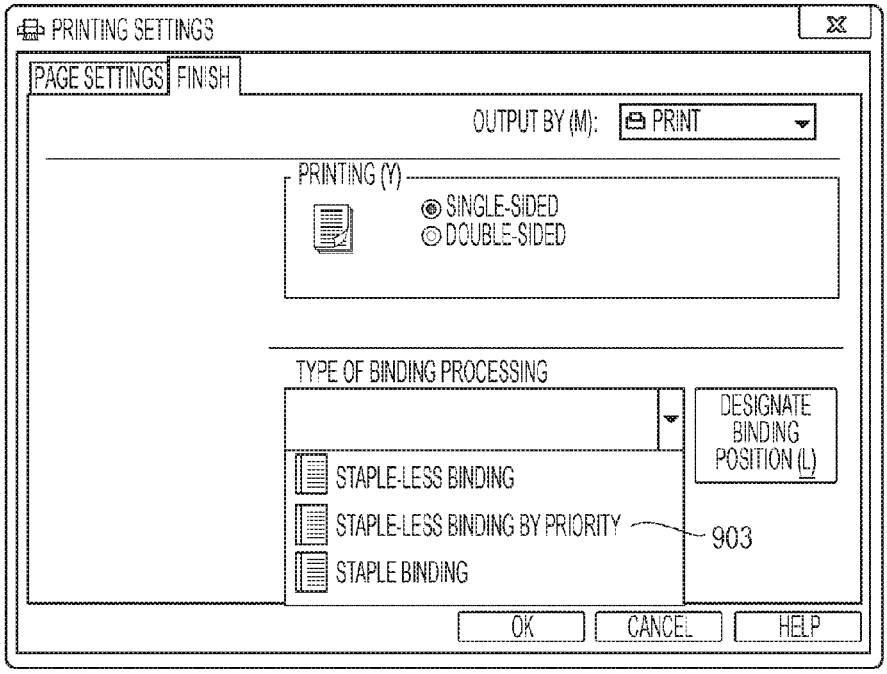

FIGS. 9A and 9B illustrate example operating screens for defining print settings. FIG. 9A illustrates a screen for setting the type of binding processing according to this embodiment. An area 911 can be selected by a user for setting the type of binding processing. When the area 911 is selected, a drop-down list including "staple-less binding" as an item 901 and "staple binding" as an item 902 is displayed. A user may select the item 901 or item 902 from the drop-down list to set the type of binding processing. A key 912 is usable for designating a position (such as an upper right position) on which binding processing is to be performed.

A key 914 is usable for transmitting print data to the image processing apparatus by a user, and a key 913 is usable for cancelling the transmission of print data.

Referring back to FIG. 8, in step S802, the CPU 1611 receives a print setting from a user through the operating screen displayed in step S801.

In step S803, the CPU 1611 determines whether the key 914 has been touched or not. If the key 914 has been touched, the processing moves to step S804. If not, the processing moves to step S805.

In step S804, the CPU 1611 generates print data based on print settings and data to be printed. Furthermore, the CPU 1611 controls the communication unit I/F 1623 so as to transmit the generated print data to the MFP 101 and ends the transmission processing. The print data generated by the CPU 1611 in step S804 may further contain output data, information regarding the number of copies to be printed, information regarding a page number of print data, and information regarding binding processing, for example.

In step S805, on the other hand, the CPU 1611 determines whether the key 913 has been touched or not. If the key 913 has been touched, the processing moves to step S806 where the transmission of print job is aborted, and the processing ends. If the key 913 has not been touched, the processing moves to step S802 where an additional print setting is received.

Figure 10A:
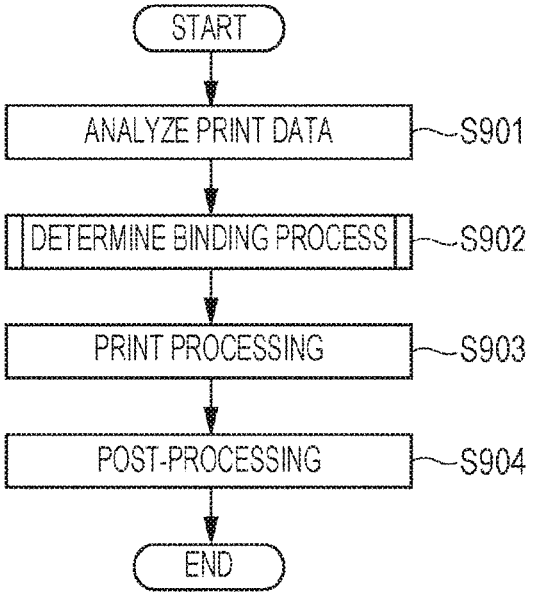
FIGS. 10A and 10B are flowcharts illustrating print processing.
Figure 10B:
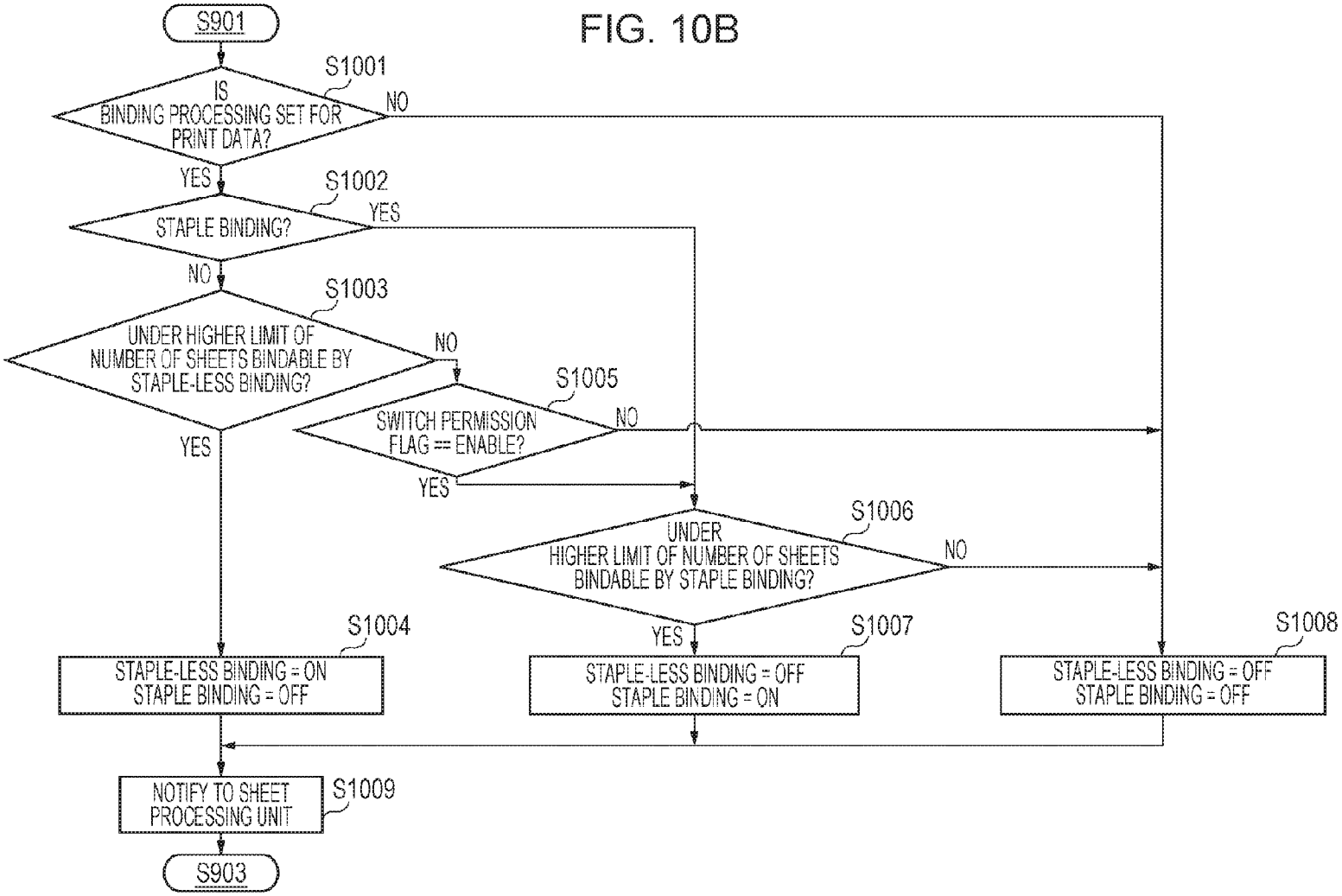

Next, print processing will be described in a case where the MFP 101 receives print data from an information processing apparatus such as the PC 102. FIGS. 10A and 10B are flowcharts illustrating print processing to be performed by the MFP 101. In response to reception of print data from the PC 102 or a print server, for example, the CPU 111 executes the flowcharts illustrated in FIGS. 10A and 10B.

The operations (steps) illustrated in the flowcharts in FIGS. 10A and 10B are implemented by reading out to the RAM 113 and executing a control program stored in the ROM 112 or the storage 114 by the CPU 111.

In step S901, the CPU 111 analyzes print data received from a PC or a print server through the communication unit I/F 123 by using the PDL analyzing unit (not illustrated). The CPU 111 stores settings relating to print attributes (print attribute information) and image data to be printed on a sheet or sheets acquired by the analysis of the print data in the RAM 113 or the storage 114.

In step S902, the type of binding processing to be executed by the sheet processing unit 122 is determined based on the print attribute information acquired by the analysis in step S901. The determination will be described in detail with reference to the flowchart in FIG. 10B. In step S903, the CPU 111 controls the print unit 120 so as to print an image based on image data stored in the RAM 113 or the storage 114 onto a sheet. After all image data are printed on corresponding sheets, the processing moves to step S904.

In step S904, the CPU 111 controls the sheet processing unit 122 so as to execute post-processing such as saddle stitching, punching a hole or holes, and binding a plurality of sheets. The CPU 111 causes execution of binding processing based on the type of binding processing determined in step S902 when post-processing for binding a plurality of sheets is executed. The CPU 111 controls the sheet processing unit 122 so as to output a sheet bundle having undergone post-processing as required to the output unit 307, and the print processing ends.

Next, a method for determining the binding processing in step S902 will be described with reference to the flowchart in FIG. 10B.

In step S1001, the CPU 111 refers to the print attribute information analyzed by the PDL analyzing unit (not illustrated) and stored in the RAM 113 or the storage 114 and determines whether binding processing is set for the print data or not. If it is determined that staple binding or staple-less binding is set for the print data, the processing moves to step S1002. On the other hand, if it is determined that none of staple binding and staple-less binding is set, the processing moves to step S1008.

In step S1002, the CPU 111 refers to the print attribute information and determines whether staple binding is set as the binding processing. If it is determined that staple binding is set, the processing moves to step S1006. If it is determined that staple binding is not set, the processing moves to step S1003.

In step S1003, the CPU 111 determines whether the number of sheets to be printed, which is calculated by the PDL analyzing unit, is less than or equal to the upper limit of the number of sheets bindable by the staple-less binding. The CPU 111 acquires the upper limit of the number of bindable sheets of the staple-less binding unit 314*b* stored in the storage 114 or the RAM 113. If the CPU 111 determines that the number of sheets to be printed is less than or equal to the acquired upper limit of the number of bindable sheets, the processing moves to step S1004. On the other hand, if the CPU 111 determines that the number of sheets to be printed is greater than the acquired upper limit of the number of bindable sheets, the processing moves to step S1005.

In step S1004, the CPU 111 determines the type of binding processing to be notified to the sheet processing unit. The CPU 111 enables the staple-less binding (ON) and disables the staple binding (OFF), and the processing moves to step S1009.

On the other hand, in step S1005, the CPU 111 refers to the switching permission flag stored in a non-volatile area and determines whether the setting for execution of the staple-less binding instead of the staple binding is valid (ENABLE) or not in accordance with the remaining number of staples. If it is determined that the setting for execution of the staple-less binding instead of the staple binding is valid, the processing moves to step S1006. On the other hand, if the CPU 111 determines whether the setting for execution of the staple-less binding instead of the staple binding is not valid (DISABLE), the processing moves to step S1008.

In step S1006, the CPU 111 determines whether the number of sheets to be printed is less than or equal to the upper limit of the number of bindable sheets of the staple binding unit 314*a*. If it is determined that the number of sheets to be printed is less than or equal to the upper limit of the number of bindable sheets of the staple binding unit 314*a*, the processing moves to step S1007. On the other hand, if it is determined that the number of sheets to be printed is greater than the upper limit of the number of bindable sheets, the processing moves to step S1008.

In step S1007, the CPU 111 disables the staple-less binding (OFF) and enables the staple binding (ON), and the processing moves to step S1009. In step S1008, the CPU 111 disables the staple-less binding (OFF) and disables the staple binding (OFF). The processing then moves to step S1009.

In step S1009, the settings for binding processing determined in step S1001 to step S1008 are notified to the sheet processing unit 122 through the sheet processing I/F 121. The processing then returns to step S903.

According to this embodiment, the binding processing is determined when print data received from an information processing apparatus is printed, and the print and binding processing is executed based on the determination. However, an embodiment of an aspect of the present invention is not limited thereto. For example, this embodiment is also applicable to printing of print data and image data stored in a document storage box area within the MFP 101 and copy processing for printing an image read by the reading unit 118.

As described above, according to this embodiment, in a case where the number of sheets to be bound is greater than the upper limit of the number of bindable sheets of staple-less binding, whether switching to staple binding is permitted or not may be set as an operational setting for the whole image processing apparatus. Therefore, the binding processing may be switched appropriately in accordance with the operational settings defined by a user and an administrator utilizing the image processing apparatus.

According to this embodiment, after print data is analyzed by the PDL analyzing unit, whether an alternative binding process is to be performed or not is determined for printing. However, the operation for analyzing print data and an operation for printing image data may be executed independently from each other.

For example, a first program may analyze print data, acquire print attribute information, and generate image data. The first program may execute the processing in the flowchart in FIG. 10B and notify the information regarding binding processing to the sheet processing unit 122. A second program may monitor an area storing image data, and, if storage of image data for one page is detected, execute printing of the image data. In this case, the printing of image data and the generation of image data of subsequent pages may be performed in parallel, which can reduce the time required for printing.

Second Embodiment

According to the first embodiment, whether the switching of binding processing from staple-less binding to staple binding is permitted or not is defined as an operational setting for the whole image processing apparatus. According to a second embodiment, the switching from staple-less binding to staple binding is to be executed or not is set for each job. It should be noted that the hardware configuration of the assumed apparatus according to the second embodiment is the same as that of the first embodiment. The detail descriptions of the same components as those of the first embodiment will be omitted.

First, print processing according to this embodiment will be described. FIG. 8 is a flowchart illustrating a control method including transmitting print data to the MFP 101. Operations (steps) in the flowchart in FIG. 8 are implemented by execution of a driver program based on the flowchart by the CPU 1611 in the PC 102. When a user instructs to print data, the CPU 1611 executes a driver program. First, in step S801, the CPU displays an operating screen for defining settings for printing on the display 1617.

FIG. 9B illustrates a screen for setting the type of binding processing according to this embodiment. According to this embodiment, the type of binding processing is set through the operating screen in FIG. 9B, instead of the operating screen in FIG. 9A according to the first embodiment. According to this embodiment, "staple binding by priority" in addition to the "staple binding" and "staple-less binding" are available as options selectable by a user for setting the type of binding processing.

An item 903 is a key for selecting execution of staple-less binding if the number of sheets to be bound is less than or equal to the upper limit of the number of sheets bindable by the staple-less binding and execution of staple binding if the number of sheets to be bound is greater than the upper limit of the number of sheets bindable by the staple-less binding. A user may touch the item 903 to set the type of binding processing for switching the binding processing to staple binding in a case where the number of sheets to be bound in the job is greater than the upper limit of the number of bindable sheets of the staple-less binding of the binding processing.

A user may touch an area 911 and select one of the item 901 to item 903 from the drop-down list to set the type of binding processing.

Referring back to FIG. 8, in step S802 to step S806, settings are received, and the transmission of print data is performed, like the first embodiment.

Figure 11:
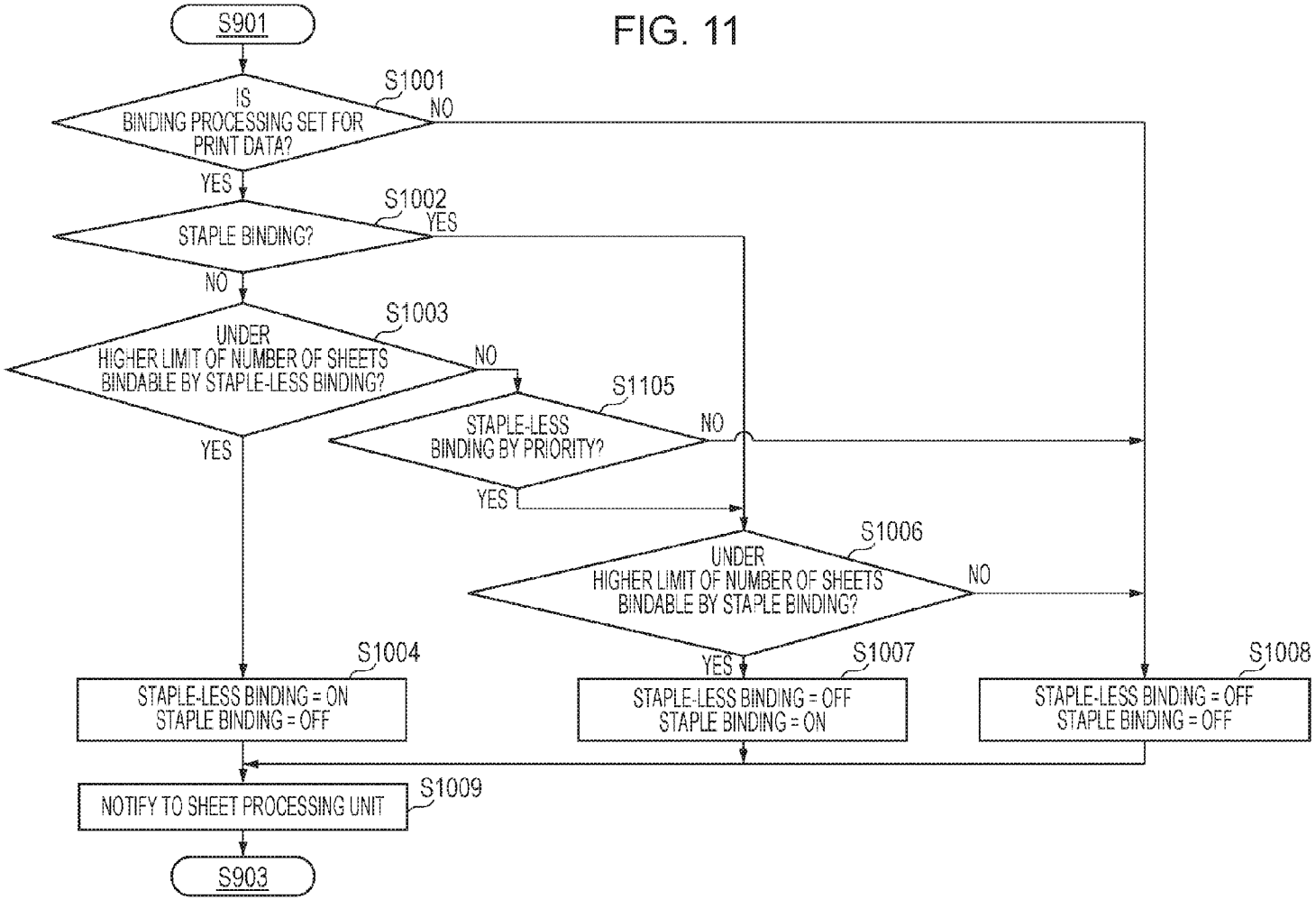
FIG. 11 is a flowchart illustrating a control method for determining a binding process.

Next, processing to be performed when the MFP 101 receives print data from an information processing apparatus such as the PC 102 will be described. The CPU 111 in response to reception of print data from the PC 102 or a print server, for example, executes the processing in the flowcharts illustrated in FIG. 10A and FIG. 11. FIG. 11 is a flowchart illustrating a control method for determining the type of binding processing according to this embodiment. According to this embodiment, the type of binding processing is determined based on the flowchart in FIG. 11, instead of the determination of the type of binding processing based on the flowchart in FIG. 10B according to the first embodiment. Because the processing in steps S901, S903, and step S904 is the same as that of the first embodiment, the repetitive description will be omitted. When the analysis of print data ends in step S901, the processing moves to the flowchart in FIG. 11 where the type of binding processing is determined.

Operations (steps) in the flowchart in FIG. 11 are implemented by reading out to the RAM 113 and executing a control program stored in the ROM 112 or the storage 114 by the CPU 111.

According to this embodiment, the processing in step S1105 is performed instead of the determination based on the switching permission flag set for the whole MFP 101 in step S1005 according to the first embodiment.

In step S1001, the CPU 111 refers to the print attribute information analyzed by the PDL analyzing unit (not illustrated) and determines whether the type of binding processing is set for the print data or not. If it is determined that staple binding or staple-less binding is set for the print data, the processing moves to step S1002. On the other hand, if none of the staple binding and the staple-less binding is set, the processing moves to step S1008.

In step S1002, the CPU 111 refers to the print attribute information and determines whether staple binding is set as the type of binding processing. If it is determined that staple binding is set, the processing moves to step S1006. If not, the processing moves to step S1003.

In step S1003, the CPU 111 determines whether the number of sheets to be printed, which is calculated by the PDL analyzing unit, is less than or equal to the upper limit of the number of bindable sheets of the staple-less binding. The CPU 111 acquires the upper limit of the number of bindable sheets of the staple-less binding unit 314*b* stored in the storage 114 or RAM 113. If the CPU 111 determines that the number of sheets to be printed is less than or equal to the acquired upper limit of the number of bindable sheets, the processing moves to step S1004. On the other hand, if the CPU 111 determines that the number of sheets to be printed is greater than the acquired upper limit of the number of bindable sheets, the processing moves to step S1105.

In step S1004, the CPU 111 determines the type of binding processing to be notified to the sheet processing unit. The CPU 111 enables the staple-less binding (ON) and disables the staple binding (OFF), and the processing moves to step S1009.

In step S1105, the CPU 111 determines whether "staple-less binding by priority" is selected as the type of binding processing. If it is determined that the "staple-less binding by priority" is set, the processing moves to step S1006. If not (that is, the staple-less binding is set), the processing moves to step S1008.

If the CPU 111 determines in step S1006 that the number of sheets to be printed is less than or equal to the upper limit of the number of bindable sheets of staple binding, the processing moves to step S1007. If it is determined that the number of sheets to be printed is greater than the upper limit of the number of bindable sheets of the staple binding, the processing moves to step S1008.

In step S1007, the CPU 111 disables the staple-less binding (OFF) and enables the staple binding (ON). The processing then moves to step S1009. In step S1008, the CPU 111 disables the staple-less binding and the staple binding (OFF).

In step S1009, the type of binding processing determined based on the flowchart in FIG. 11 is notified to the sheet processing unit 122 through the sheet processing I/F 121. The processing then moves to step S903. In and after step S903, print processing and post-processing is executed.

Having described that according to this embodiment, the type of binding processing is determined when print data received from the information processing apparatus is printed, an embodiment of an aspect of the present invention is not limited thereto. For example, this embodiment is also applicable to printing print data and image data stored in a document storage box area within the MFP 101 and copy processing for printing an image read by the reading unit 118.

As described above, according to this embodiment, in a case where the number of sheets to be bound is greater than the upper limit of the number of bindable sheets of staple-less binding, whether switching to staple binding is permitted or not may be set for each job. Therefore, the binding processing may be switched appropriately in accordance with the job settings defined by a user utilizing the image processing apparatus, which can inhibit output of a result against the user's intension.

Third Embodiment

According to the first embodiment, whether the switching of binding processing from staple-less binding to staple binding is to be executed or not is defined based on the corresponding operational setting for the whole image processing apparatus. According to the second embodiment, the switching from staple-less binding to staple binding is to be executed or not is set for each job.

As described above, the staple-less binding is achieved by crimping sheets. Thus, sheets can be peeled off from each other more easily than staple binding. The staple-less binding may be performed by using the feature and intending to peel off the sheets from each other later.

In view of this, according to the third embodiment, the switching from staple-less binding to staple binding is to be executed or not is determined in accordance with a job setting. It should be noted that the hardware configuration of the assumed apparatus according to the third embodiment is the same as that of the first embodiment. Like numbers refer to like parts in the configurations according to the first embodiment, the second embodiment, and the third embodiment, and detail descriptions will be omitted.

Figure 12:
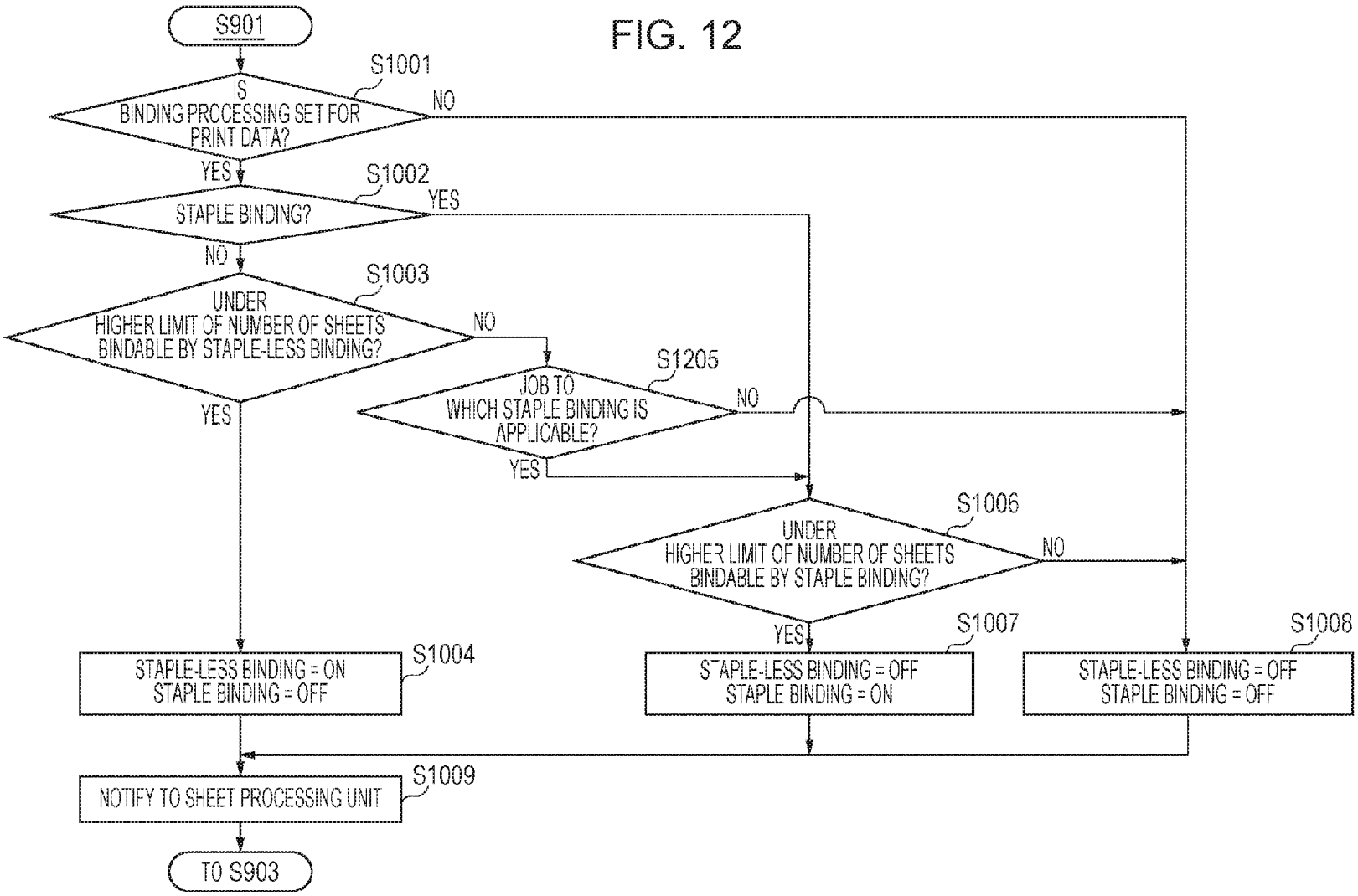
FIG. 12 is a flowchart illustrating a control method for determining a binding process.

First, print processing according to this embodiment will be described. In response to reception of print data from the PC 102 or print server, for example, the CPU 111 executes processing in flowcharts illustrated in FIG. 10A and FIG. 12. FIG. 12 is a flowchart illustrating a control method for determining the type of binding processing according to this embodiment. According to this embodiment, the type of binding processing is determined based on the flowchart in FIG. 12, instead of the determination of the type of binding processing based on FIG. 10B according to the first embodiment. Because the processing in steps S901, S903, and step S904 is the same as that of the first embodiment, the repetitive description will be omitted. When the analysis of print data ends in step S901, the processing moves to the flowchart in FIG. 12 where the type of binding processing is determined.

Operations (steps) in the flowchart in FIG. 12 are implemented by reading out to the RAM 113 and executing a control program stored in the ROM 112 or the storage 114 by the CPU 111.

In the flowchart in FIG. 12, determination based on a setting for a job is performed in step 1205, instead of the determination on whether staple binding by priority is set or not based on step S1105 according to the second embodiment.

In step S1001 to step S1003, the CPU 111 performs the determination based on the type of binding processing, like the first embodiment. If the CPU 111 determines that the number of sheets to be printed is greater than the upper limit of the number of bindable sheets of staple-less binding in step S1003, the processing moves to step S1205.

In step S1205, the CPU 111 determines whether the job is set to permit staple binding or not based on the corresponding setting in print data. For example, in a case where no carbon paper (pressure-sensitive paper) is designated as the sheet type to be used for printing or where group sorting is designated as post-processing, the CPU 111 determines that staple binding is not permitted. Therefore, the processing moves to step S1008. On the other hand, if such a setting is not designated, it is determined that the staple binding is applicable. The processing then moves to step S1006.

No carbon paper is a sheet to be used for an account book, an application form or a receipt requiring a duplicate copy thereof. No carbon paper includes a set of an upper sheet, a middle sheet and a lower sheet which are overlaid in this order. Text hand-written on the upper sheet can be duplicated to the middle sheet and the lower sheet. Staple-less binding may be performed to bind a set of such an upper sheet, a middle sheet and a lower paper having print data of frames, for example, printed as one bundle. There is a high possibility that that case assumes that the bound sheets will be peeled from each other after text is hand-written on the upper sheet and is duplicated onto the middle sheet and lower sheet.

The group sort function may be performed for sorting processed matters page by page of a document and discharging them copy by copy. For example, in order to print three copies of five pages of a document, for example, a bundle of three sheets corresponding to one identical page is output. Here, staple-less binding may be performed to temporarily bind the bundle of one copy. In this case, there is a high possibility that the bound sheets are assumed to be peeled from each other.

According to this embodiment, for a print job for which staple-less binding process is designated, control is implemented to inhibit switching to staple binding for a print setting having a high possibility that bound sheets will be peeled off from each other. Having described, for example, that according to this embodiment, the control for inhibiting the switching to staple binding is performed in a case where no carbon paper or the group sorting is designated, aspects of the present invention are not limited thereto. Alternatively, the control for inhibiting the switching to staple binding may be implemented for other print settings having a possibility that the bound sheets will be peeled off from each other.

In step S1004, and step S1006 to step S1008, the CPU 111 performs the same processing as that of the second embodiment and determines the type of binding processing and notifies it to a sheet processing unit. Then, the processing returns to step S903. In and after step S903, print processing and post-processing is executed.

Having described that according to this embodiment, the type of binding processing is determined before print data received from an information processing apparatus is printed, aspects of the present invention are not limited thereto. For example, this embodiment is also applicable to printing of print data and image data stored in a document storage box area within the MFP 101 and copy processing for printing an image read by the reading unit 118.

As described above, according to this embodiment, when the number of sheets to be bound is greater than the upper limit of the number of bindable sheets of staple-less binding, whether switching to staple binding is performed or not can be determined in accordance with settings for the job. Therefore, the binding processing can be switched appropriately in accordance with settings for a job defined by a user utilizing the image processing apparatus.

The determination on whether switching to staple binding is to be performed or not according to the first embodiment or second embodiment may be applied to this embodiment.

When the first embodiment is applied, the determination in step S1005 may be performed before or after the determination in step S1205. In this case, when a setting for binding by switching to staple binding is defined for the whole apparatus, and when the job is a job to which staple binding is applicable, the switching to staple binding is performed.

When the second embodiment is applied, the determination in step S1105 may be performed before or after step S1205. In this case, when the "staple binding by priority" is set for a job and when the job is a job to which staple binding is applicable, the switching to staple binding is performed.

Other Embodiments

Having described that according to the first to third embodiments, when the determinations in step S1005, step S1105, and step S1205 determines not to switch to staple binding, resulting sheets are output without performing binding processing, aspects of the present invention are not limited thereto. For example, when it is determined not to perform the switching to staple binding, the resulting sheets may be divided into separate volumes by performing staple-less binding.

Having described that according to the first to third embodiments, the MFP 101 includes the sheet processing unit 122, aspects of the present invention are not limited thereto. For example, a sheet processing unit including the staple binding unit and the staple-less binding unit may be provided separately from the image processing apparatus and may be connected to the image processing apparatus for execution of binding processing. In this case, the MFP 101 acquires as required the capability relating to the binding processing from the separate sheet processing unit.

Furthermore, the first to third embodiments may also be applied to a case where whether an alternative binding process to staple binding is to be performed or not is determined in advance in a print control device such as a print server (not illustrated) instead of the MFP 101. In this case, the print control device may acquire as required the capability relating to the binding processing of the MFP 101. The print control device if applied may analyze print data determine whether the alternative binding process is to be performed or not and then change print attributes relating to the binding process.

Embodiments of aspects of the present invention can also be realized by a computer of a system or apparatus that reads out and executes computer executable instructions recorded on a storage medium (e.g., non-transitory computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Having described exemplary embodiments of aspects of the present invention above, it should be understood that the aspects of the present invention are not limited by such specific embodiments, and various modification, alteration and changes may be made thereto without departing from the spirit and scope of aspects of the claimed invention.

According to aspects of the present invention, the switching to a binding process by using a staple or staples may be performed appropriately so that a mechanism which performs binding process suitable for a user's application can be provided.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-001684, filed Jan. 7, 2015, which is hereby incorporated by reference herein in its entirety.

What is claimed is:

1. A sheet processing apparatus comprising:

a printing unit configured to perform a printing process in which an image is formed on sheets;

a first binding unit configured to perform a first binding process on sheets;

a second binding unit capable of binding sheets by performing a second binding process on the sheets of which a number of the sheets is greater than an upper limit of a number of sheets performable with the first binding process by the first binding unit;

a setting unit configured to set whether or not to switch a binding process from the first binding process to the second binding process in advance of starting the printing process, in a case where the first binding process is designated and where the number of sheets to be bound exceeds the upper limit of the number of sheets performable with the first binding process by the first binding unit; and a control unit configured to, (i) cause the first binding unit to perform the first binding process on sheets printed in the printing process in a case where the first binding process is designated and where the number of sheets to be bound is not greater than the upper limit of the number of sheets performable with the first binding process by the first binding unit, (ii) cause the second binding unit to perform the second binding process on sheets printed in the printing process in a case where the first binding process is designated and where the number of sheets to be bound is greater than the upper limit of the number of sheets performable with the first binding process by the first binding unit and where a switching the binding process from the first binding process to the second binding process is set by the setting unit, and (iii) cause the second binding unit to perform the second binding process on sheets printed in the printing process in a case where the second binding process is designated, wherein the second binding unit does not perform the second binding process on sheets in a case where the first binding process is designated and where the number of sheets to be bound is greater than the upper limit of the number of sheets performable with the first binding process by the first binding unit and where the setting unit is set not to execute the switching to the second binding process.

2. The sheet processing apparatus according to claim 1, wherein the control unit controls such that the second binding process is performed in a case where the second binding process is designated even in a case where the number of sheets to be bound is less than the upper limit of the number of sheets bindable by the first binding unit.

3. The sheet processing apparatus according to claim 1, wherein the control unit controls such that the printed sheet is output without binding when the number of sheets to be bound is greater than the upper limit of the number of sheets which the first binding unit can perform the first binding process on in a case where the first binding process is designated and the setting unit sets not to switch to the second binding process.

4. The sheet processing apparatus according to claim 1, wherein the control unit controls to divide sheets to be bound into sheet bundles each containing a number of sheets permitting the first binding process and perform the first binding process when the number of sheets to be bound is greater than the upper limit of the number of sheets that the first binding unit can perform the first binding process in a case where the first binding process is designated and the setting unit sets not to switch to the second binding unit.

5. The sheet processing apparatus according to claim 1, wherein the first binding unit is a staple-less binding unit configured to perform a binding process without using any staples; and the second binding unit is a staple binding unit configured to perform a binding process by using at least one staple.

6. The sheet processing apparatus according to claim 5, wherein the first binding unit performs a binding process for crimping and binding sheets by causing the sheets to be caught between a first member and a second member.

7. The sheet processing apparatus according to claim 1, wherein the printing unit configured to print image on sheets based on a job, wherein the control unit controls not to perform the second binding process in accordance with a print setting for the job even in a case where the setting unit sets to switch to the second binding unit.

8. The sheet processing apparatus according to claim 7, wherein the control unit controls not to perform the second binding process in a case where it is set to use pressure-sensitive paper to print as a print setting for the job though the setting unit sets to switch to the second binding unit.

9. The sheet processing apparatus according to claim 7, wherein the control unit controls not to perform the second binding process in a case where group sorting is set as a print setting for the job even though the setting unit sets to switch to the second binding unit.

10. The sheet processing apparatus according to claim 1, wherein the setting on the setting unit and a setting related to the print process are set independently.

11. The sheet processing apparatus according to claim 1, wherein the second binding unit performs the second binding process on sheets printed in the printing process without any user's operation on the setting unit after the printing process is started in a case where the first binding process is designated and where the number of sheets to be bound is greater than the upper limit of the number of sheets performable with the first binding process by the first binding unit and where the setting unit is set to execute the switching to the second binding process.

12. A control method for a sheet processing apparatus including a printing unit configured to perform a printing process in which an image is formed on sheets, a first binding unit configured to perform a first binding process on sheets, and a second binding unit capable of binding sheets by performing a second binding process on the sheets of which a number of the sheets is greater than an upper limit of a number of sheets performable with the first binding process by the first binding unit, the method comprising:

setting whether or not to switch a binding process from the first binding process to the second binding process in advance of starting the printing process, in a case where the first binding process is designated and where the number of sheets to be bound exceeds the upper limit of the number of sheets performable with the first binding process by the first binding unit; and controlling, (i) the first binding unit to perform the first binding process on sheets printed in the printing process in a case where the first binding process is designated and where the number of sheets to be bound is not greater than the upper limit of the number of sheets performable with the first binding process by the first binding unit, (ii) the second binding unit to perform the second binding process on sheets printed in the printing process in a case where the first binding process is designated and where the number of sheets to be bound is greater than the upper limit of the number of sheets performable with the first binding process by the first binding unit and where a switching the binding process from the first binding process to the second binding process is set by a setting unit, and (iii) the second binding unit to perform the second binding process on sheets printed in the printing process in a case where the second binding process is designated, wherein the second binding unit does not perform the second binding process on sheets in a case where the first binding process is designated and where the number of sheets to be bound is greater than the upper limit of the number of sheets performable with the first binding process by the first binding unit and where the setting unit is set not to execute the switching to the second binding process wherein the second binding unit does not perform the second binding process on sheets in a case where the first binding process is designated and where the number of sheets to be bound is greater than the upper limit of the number of sheets performable with the first binding process by the first binding unit and where the setting unit is set not to execute the switching to the second binding process.

13. A non-transitory computer-readable storage medium storing computer executable instructions causing a computer in a sheet processing apparatus including a printing unit configured to perform a printing process in which an image is formed on sheets, a first binding unit configured to perform a first binding process on sheets, and a second binding unit capable of binding sheets by performing a second binding process on the sheets of which a number of the sheets is greater than an upper limit of a number of sheets performable with the first binding process by the first binding unit to execute a control method, the control method comprising:

setting whether or not to switch a binding process from the first binding process to the second binding process in advance of starting the printing process, in a case where the first binding process is designated and where the number of sheets to be bound exceeds the upper limit of the number of sheets performable with the first binding process by the first binding unit; and controlling, (i) the first binding unit to perform the first binding process on sheets printed in the printing process in a case where the first binding process is designated and where the number of sheets to be bound is not greater than the upper limit of the number of sheets performable with the first binding process by the first binding unit, (ii) the second binding unit to perform the second binding process on sheets printed in the printing process in a case where the first binding process is designated and where the number of sheets to be bound is greater than the upper limit of the number of sheets performable with the first binding process by the first binding unit and where a switching the binding process from the first binding process to the second binding process is set by a setting unit, and (iii) the second binding unit to perform the second binding process on sheets printed in the printing process in a case where the second binding process is designated, wherein the second binding unit does not perform the second binding process on sheets in a case where the first binding process is designated and where the number of sheets to be bound is greater than the upper limit of the number of sheets performable with the first binding process by the first binding unit and where the setting unit is set not to execute the switching to the second binding process wherein the second binding unit does not perform the second binding process on sheets in a case where the first binding process is designated and where the number of sheets to be bound is greater than the upper limit of the number of sheets performable with the first binding process by the first binding unit and where the setting unit is set not to execute the switching to the second binding process.

* * * * *